US008448455B2

(12) United States Patent
Strobel

(10) Patent No.: US 8,448,455 B2
(45) Date of Patent: May 28, 2013

(54) METHOD FOR COOLING A CRYOSTAT CONFIGURATION DURING TRANSPORT AND CRYOSTAT CONFIGURATION WITH TRANSPORT COOLER UNIT

(75) Inventor: Marco Strobel, Karlsruhe (DE)

(73) Assignee: Bruker BioSpin GmbH, Rheinstetten (DE)

( * ) Notice: Subject to any disclaimer, the term of this patent is extended or adjusted under 35 U.S.C. 154(b) by 850 days.

(21) Appl. No.: 12/458,121

(22) Filed: Jul. 1, 2009

(65) Prior Publication Data

US 2010/0005814 A1 Jan. 14, 2010

(30) Foreign Application Priority Data

Jul. 3, 2008 (DE) ..... 10 2008 031 486

(51) Int. Cl.
*F17C 3/08* (2006.01)
*F25B 19/00* (2006.01)

(52) U.S. Cl.
USPC ..... 62/51.1; 62/45.1

(58) Field of Classification Search
USPC ..... 62/45.1, 51.1, 53.2
See application file for complete search history.

(56) References Cited

U.S. PATENT DOCUMENTS

| | | | | |
|---|---|---|---|---|
| 5,979,176 | A | 11/1999 | Stables | |
| 6,453,680 | B1 * | 9/2002 | Allen | 62/45.1 |
| 7,140,190 | B2 | 11/2006 | Daniels | |
| 7,474,099 | B2 | 1/2009 | Boesel | |
| 2005/0109043 | A1 | 5/2005 | Chan | |
| 2006/0010881 | A1 | 1/2006 | Gustafson | |
| 2006/0288731 | A1 | 12/2006 | Atkins et al. | |
| 2009/0007573 | A1 * | 1/2009 | Noonan et al. | 62/51.1 |
| 2009/0275478 | A1 * | 11/2009 | Atkins et al. | 505/163 |

FOREIGN PATENT DOCUMENTS

| | | |
|---|---|---|
| EP | 0 326 967 | 8/1989 |
| EP | 0 468 425 | 1/1992 |
| EP | 0 726 582 | 8/1996 |
| EP | 1 742 234 | 1/2007 |
| GB | 2 414 536 | 11/2005 |
| GB | 2 431 981 | 5/2007 |
| GB | 2431981 A * | 5/2007 |

(Continued)

OTHER PUBLICATIONS

"BioSpec", Bruker BioSpin, http://www.bruker-Biospin.com/biospec.htm, Jun. 4, 2008.
"Ultra Shield Refrigerated Magnet Technology" Bruker BioSpin, http://www.bruker-biospin.com/mri_usr_technology.htm, Jun. 3, 2008.
"Magnetic Separation Systems" Cryomagnetics, Inc., http://www.cryomagnetics.com/separation-systems.htm.

*Primary Examiner* — Frantz Jules
*Assistant Examiner* — Keith Raymond
(74) *Attorney, Agent, or Firm* — Paul Vincent

(57) ABSTRACT

A method for cooling a cryostat configuration (1, 1') during transport, wherein the cryostat configuration (1) comprises a superconducting magnet coil (2) in a helium tank (8) containing liquid helium (9), which is surrounded by at least one radiation shield (10), wherein the cooling inside the cryostat configuration (1, 1') in stationary operation is performed entirely without liquid nitrogen by means of a refrigerator, characterized in that during transport, the refrigerator is switched off and instead, liquid nitrogen (6) is conducted from an external nitrogen vessel (4) via a supply tube (7) from the nitrogen vessel (4) to the cryostat configuration (1, 1') and brought into thermal contact with the radiation shield (10) by means of a thermal contact element (11) in the cryostat configuration (1, 1'). In this way, the consumption of liquid helium during transport can be greatly reduced and the possible transport time of a charged superconducting magnet configuration increased.

20 Claims, 4 Drawing Sheets

FOREIGN PATENT DOCUMENTS

| | | | |
|---|---|---|---|
| WO | WO 2005/116514 | | 12/2005 |
| WO | Wo 2005/116515 | | 12/2005 |
| WO | WO 2005116515 | A1 * | 12/2005 |
| WO | WO 2007/052065 | | 5/2007 |

* cited by examiner

METHOD FOR COOLING A CRYOSTAT CONFIGURATION DURING TRANSPORT AND CRYOSTAT CONFIGURATION WITH TRANSPORT COOLER UNIT

This application claims Paris Convention priority of DE 10 2008 031 486.2 filed Jul. 3, 2008 the complete disclosure of which is hereby incorporated by reference.

BACKGROUND OF THE INVENTION

The invention relates to a method for cooling a cryostat configuration during transport, wherein the cryostat configuration comprises a superconducting magnet coil in a helium tank containing liquid helium, which is surrounded by at least one radiation shield, wherein the cooling inside the cryostat configuration in stationary operation is performed entirely without liquid nitrogen using a refrigerator. The invention also relates to a cryostat configuration with an outer shield within which a helium tank for liquid helium is installed, which contains a superconducting magnet coil and with at least one radiation shield surrounding the helium tank, wherein the cryostat configuration is cooled by a refrigerator entirely without liquid nitrogen during stationary operation.

Such a configuration is known, for example, from U.S. Pat. No. 714,190 B2.

Superconducting magnets consist of windings made of superconducting wire that are cooled down to temperatures of 4.2 Kelvin using liquid helium. The principal task of the cryostat configuration is to maintain the superconducting magnet at the specified operating temperature with liquid helium while consuming as little coolant as possible.

The main components of known cryostat configurations are the helium tank, which contains the superconducting magnet coil and liquid helium, the outer jacket, which acts as an outer vacuum vessel, and a neck tube, which connects the helium tank to the outer shield. The helium tank is surrounded by a vacuum space, which is delimited by the helium tank itself, the neck tube, and the outer jacket.

To reduce the heat input into the helium tank and thus into the superconducting magnet coil, it was previously common practice to surround the helium tank not only with radiation shields but also with a nitrogen tank containing liquid nitrogen, which was permanently installed in the cryostat. However, such configurations require frequent maintenance as the nitrogen tank usually has to be refilled every two weeks due to evaporation of the liquid nitrogen.

EP 0 468 425 A2 describes a cryostat configuration with a nitrogen tank that surrounds the helium tank, which is cooled by means of a refrigerator. It is thereby possible to reduce the nitrogen consumption and, therefore, the number of maintenance interventions in this way. However, all cryostat configurations with a nitrogen tank have the disadvantage that the resulting cryostat configuration is very large due to incorporation of the nitrogen tank and therefore occupies a large amount of space in the laboratory.

Modern cryostats of superconducting magnets therefore use a refrigerator to directly cool the radiation shield. Depending on the type of construction, the refrigerator is also able to prevent evaporation of helium by recondensing the helium gas in the helium tank. Such a cryostat configuration is known, for example, from U.S. Pat. No. 7,140,190 B2 and www.bruker-biospin.com/biospec, www.bruker-biospin.com/mri_usr_technology. Such cryostat configurations, which use refrigerators for the direct cooling of radiation shields, can be operated fully nitrogen free. This permits more compact cryostat configurations to be implemented and maintenance costs to be saved because maintenance interventions, such as replenishing the nitrogen and vacuum testing of the nitrogen vessel, are no longer necessary.

Transport of such cryostat configurations to their destination is preferably performed in the cold state because, in many installation locations, no service personnel with expert knowledge are available, and the cooling time of a superconducting magnet configuration disposed in a cryostat configuration as described above can take up to three weeks, during which time specialist personnel must be available on site.

However, the transport of cryostat configurations in the cold state is a time-critical and expensive undertaking. Transport by airfreight, although less problematic, is, however, very expensive. Transport by sea is considerably cheaper but very time consuming. Since the refrigerator consumes a large amount of electrical energy, it is almost logistically impossible to run it while the cryostat configuration is being transported: The compressor of the cold head requires up to 15 kW of electrical power, a large part of which is converted to heat and usually has to be dissipated by water-cooling. For this, a water circuit has to be connected to a water cooler during transport, which consumes roughly the same amount of electrical power as the compressor. The entire system must be monitored by a control unit, which also requires electrical energy. Furthermore, the large quantity of waste heat must be allowed to escape from the transport system which will otherwise heat up. All these constraints would make operating a refrigerator during transport extremely complicated and therefore very expensive.

However, if the refrigerator is not run, the radiation shield continues to heat up until the dissipating helium cools down the radiation shield in accordance with the energy that is incident upon the radiation shield, and an equilibrium temperature is established. This is usually around 100-150 Kelvin. The thermal losses are then considerable and can result in evaporation rates of 5 liters of LHe (liquid helium)/hour. The residence time (i.e. the time until no more helium is to be found in the magnet) sinks to well below one month and makes transport to remote regions or by ship practically impossible without the magnet becoming dry and therefore heating up during transport, that is, there is no more liquid helium in the helium tank. In such cases, only expensive airfreight transport is possible.

The object of this invention is therefore to suggest a method by which the consumption of liquid helium can be greatly reduced during transport and the possible transport time of a cooled superconducting magnet configuration therefore increased.

SUMMARY OF THE INVENTION

This object is inventively solved by switching off the refrigerator during transport and instead conveying liquid nitrogen from an external nitrogen vessel via a supply tube from the nitrogen vessel to the cryostat configuration and bringing it into thermal contact with the radiation shield by means of a thermal contact element in the cryostat configuration.

In the inventive method, the radiation shield is therefore not cooled by means of the refrigerator during transport but by means of liquid nitrogen, which is, however, not stored in the cryostat configuration itself but outside in one or more external nitrogen vessels. This makes it possible to maintain the radiation shield at temperatures of approx. 80 K. Neither electrical energy nor a water supply is required during transport. Instead of liquid nitrogen, other liquefied gases with a temperature above that of liquid helium can be used, for example, air, or an inert gas. By this method, the evaporation rate of the helium in the helium tank can be reduced by a factor of 1.5-12, preferably of 2.5-12, without generating waste heat, without the need to introduce elaborate provisions for running a refrigerator or having to dispense with the compact design of the cryostat configuration cooled without nitrogen in stationary operation.

With the inventive method, it is therefore possible to implement a low-cost and simple method of transport cooling without dispensing with the advantages of a nitrogen-free-cooled cryostat configuration in stationary operation (fewer maintenance interventions and nevertheless a compact cryostat configuration).

The supply of liquid nitrogen to the contact element is preferably activated when transport starts and deactivated again at the end of transport. Therefore, the radiation shield is only cooled with nitrogen during transport. Consequently, the nitrogen vessels are only required during transport and can be removed from the cryostat configuration after transport and returned to the supplier. The nitrogen vessels are dimensioned such that they can be returned together with the usual installation kit.

In a preferred variant of the inventive procedure, the refrigerator is removed from the cryostat configuration before the supply of liquid nitrogen to the contact element is activated and installed again after the liquid nitrogen supply has been deactivated.

The inventive cryostat configuration for performing the procedure described above is characterized in that a thermal contact element is provided of which at least one stationary section is in permanent thermal contact with the radiation shield, and in that a supply tube is provided for introducing the liquid nitrogen from a nitrogen vessel disposed outside the cryostat configuration to the contact element.

In a highly preferred embodiment, the nitrogen vessel is removed from the cryostat configuration before stationary operation starts. The inventive cryostat configuration therefore does not differ in its dimensions during stationary operation from cryostat configurations of prior art. What is more, the nitrogen vessels can thereby be easily refilled and possibly used for other tasks.

The stationary section of the contact element can either be a solid body integrated in the cryostat configuration or a hollow body that makes contact with the radiation shield and through which nitrogen can be introduced via the supply tube.

In a special embodiment, at least one section of the supply tube for supplying liquid nitrogen is permanently installed in the cryostat configuration. The permanently installed section of the supply tube can be connected to an external section of the supply tube that leads to the nitrogen vessel for transporting the cryostat configuration.

It is particularly advantageous, for example, if the supply tube for introducing liquid nitrogen can be removed from the cryostat configuration before stationary operation starts. The supply tube required for cooling during transport therefore occupies no space within the cryostat configuration during stationary operation.

In a further variation of this embodiment, a supply tube for introducing liquid nitrogen is detachably connected to the stationary section of the contact element. Such an embodiment applies, for example, when the stationary section surrounds a hollow space and the supply tube that can be removed from the cryostat configuration is connected directly to the hollow space of the stationary section in order to introduce the nitrogen for transport cooling.

Alternatively, in a highly preferred further embodiment of the inventive cryostat configuration, the supply tube for introducing liquid nitrogen is connected to a movable section of the contact element and can be removed from the cryostat configuration together with the latter before stationary operation starts. The moving section of the contact element, like the stationary section, can be a hollow space filled with nitrogen or a solid body that is in thermal contact with the nitrogen from the external nitrogen vessel.

The inventive cryostat configuration is particularly advantageous if a neck tube is provided to contain a cold head of the refrigerator, wherein one end of the neck tube is connected to the outer jacket and its other end is connected to the helium tank, wherein the contact element is disposed inside the neck tube and the stationary section of the contact element makes thermally conductive contact with a cold stage of the cold head during stationary operation and with the liquid nitrogen transported via the supply tube during transport operation. The thermal contact between the radiation shield and the nitrogen is therefore established in the neck tube, which is usually used to accommodate the cold head. In this case, no additional modifications have to be made to the magnet (cooling tubes etc.), which would result in additional losses during normal operation.

In a further advantageous embodiment of the inventive cryostat configuration, the stationary section of the contact element comprises at least two contact surfaces between which a gas gap is located, via which heat is dissipated from the radiation shield. As far as possible, the two contact surfaces make form-fit contact, wherein the gas gap is preferably filled with helium gas. This results in very good thermal contact without the need to apply mechanical force (e.g. using screws).

One advantageous embodiment comprises at least one fixing facility for fixing at least one nitrogen vessel, which is disposed on the exterior of the outer shield. The nitrogen tank can then be detachably connected to the exterior of the outer shield.

The refrigerator is preferably either a pulse tube cooler or a Gifford-McMahon cooler.

The cold head of the refrigerator preferably comprises two cold stages that can be operated at different cryogenic temperatures. The first cold stage can be used in stationary operation of the cryostat configuration to cool the radiation shield, while helium from the helium tank can be reliquefied with the second (colder) cold stage.

The advantages of the invention are particularly beneficial if the superconducting magnet coil is part of an MR magnet, in particular, part of an NMR, MRI, or FTMS configuration.

The invention also relates to a transport vessel for transporting an inventive cryostat configuration with an installed nitrogen vessel with liquid nitrogen and a supply tube that leads from the nitrogen vessel to a connection device for connection to a cryostat configuration.

To simplify and accelerate loading and transport of the transport vessel, it is advantageous if the transport vessel has standard dimensions, in particular according to ISO 668. The inventive cryostat configuration can be conveyed by means of such a transport vessel with a wide range of different means of transport (ocean-going and inland waterway vessels, railroad, truck) and quickly transshipped.

Further advantages of the invention can be derived from the description and the drawing. The characteristics stated above and below can be used individually or any number of them may be used in any combination. The embodiments shown and described are not intended as an exhaustive list but are examples used to describe the invention.

DESCRIPTION OF THE PREFERRED EMBODIMENT

Figure 1:
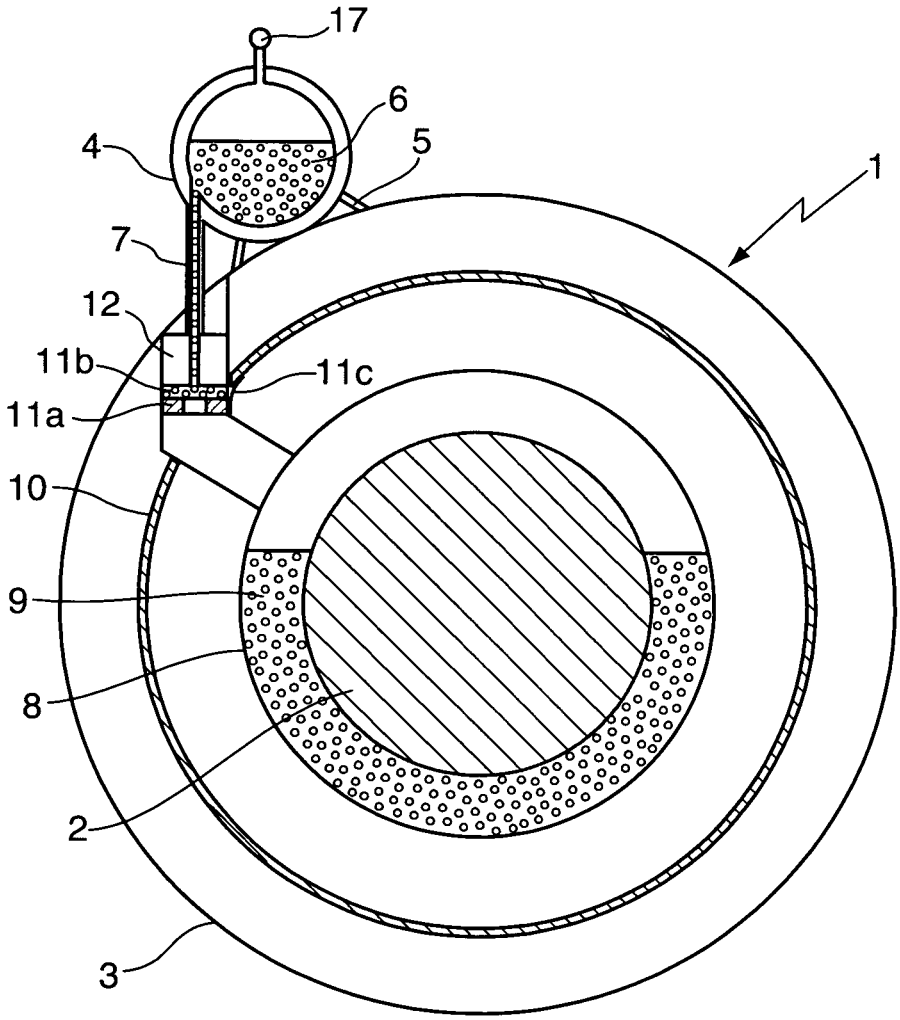
FIG. 1 a cross-section of an inventive cryostat configuration with an external nitrogen tank that is connected to the radiation shield via a contact element disposed in the neck tube of the cryostat configuration.

FIG. 1 shows an inventive cryostat configuration 1 that is suitable for long transport with a cooled superconducting magnet coil 2 without the superconducting magnet coil 2 becoming dry. The cryostat configuration 1 comprises an outer jacket 3 to whose exterior a nitrogen vessel 4 is detachably attached with a fixing facility. In the present example, the fixing facility comprises fixing clip 5 and additional connection elements disposed on the outer shield, such as, for example, thread holes, bolts etc., with which the fixing clip 5 can preferably be detachably connected to the outer shield. Liquid nitrogen 6 can be conveyed to the inside of the cryostat configuration 1 via a supply tube 7.

The superconducting magnet coil 2 to be cooled is located in helium tank 8 containing liquid helium 9, which is surrounded by a radiation shield 10. A vacuum space is disposed between the radiation shield 10 and the helium tank 8, and between the radiation shield 10 and outer jacket 3. To reduce the liquid helium losses, a heat-conducting connection is established on the inventive cryostat configuration 1 between the liquid nitrogen 6 emanating from the external nitrogen vessel 4 and the radiation shield 10. The radiation shield 10 is in permanent thermal contact with a stationary section 11*a* of a contact element via a flexible coupling element 11*c*, wherein the stationary section 11*a* can itself be connected to a non-stationary, movable section 11*b* of the contact element with thermal conductance. The movable section 11*b* is disposed here as a hollow space and mechanically connected with the supply tube 7 in such a way that the liquid nitrogen 6 can make its way from the external nitrogen vessel 4 into the hollow space of the movable section 11*b* of the contact element.

Heat transfer from the radiation shield 10 to the liquid nitrogen 6 is implemented by the thermal contacting of the movable section 11*b* and the stationary section 11*a*. A discharge valve 17 is disposed in the nitrogen vessel 4 to avoid overpressure in the nitrogen vessel 4 resulting from the introduction of heat to the nitrogen. Instead or in addition, a valve to diffuse the nitrogen gas can also be disposed in the supply tube 7.

Figure 2A:
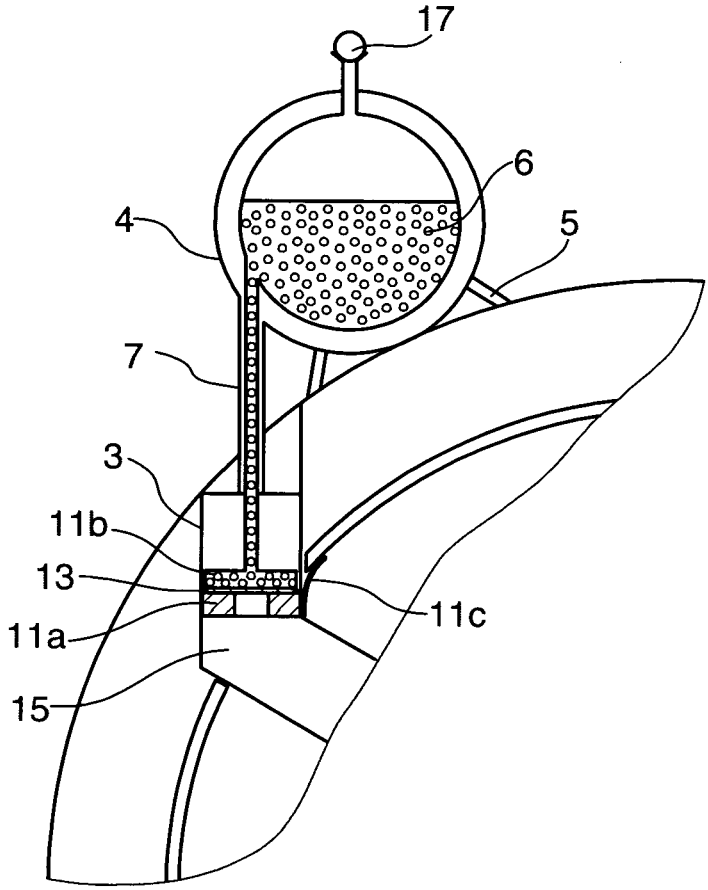
FIG. 2*a* a detail view of the inventive cryostat configuration in FIG. 1 with a fixed nitrogen vessel and the contacted movable section of the contact element.
Figure 2B:
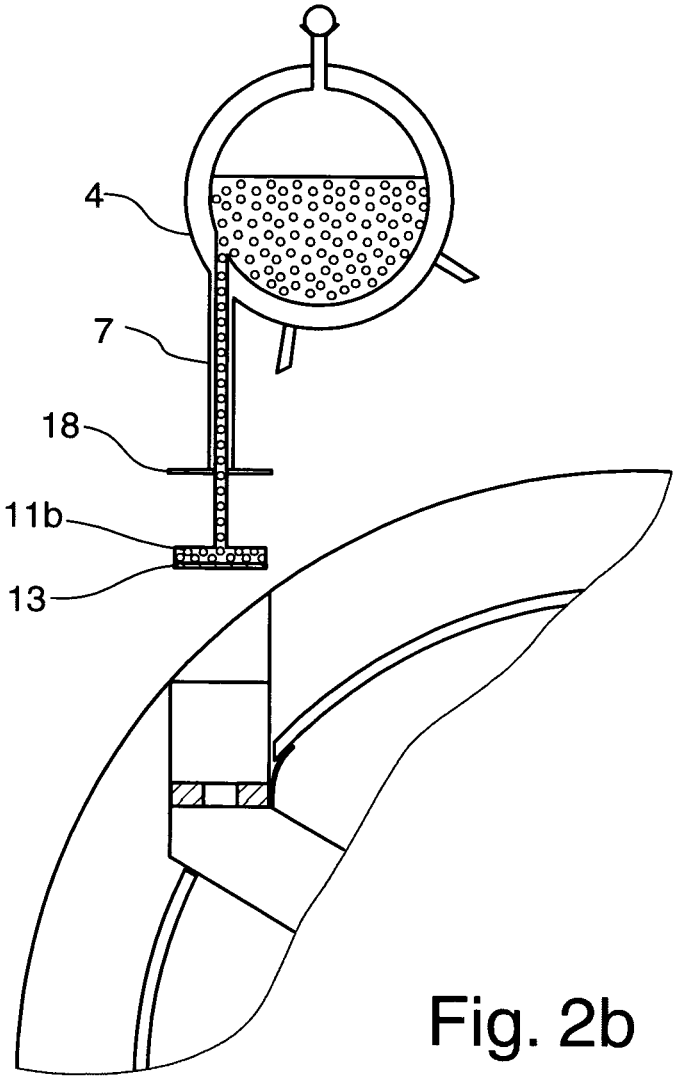
FIG. 2*b* a detail view of the inventive cryostat configuration in FIG. 1 in which the nitrogen vessel and the movable section of the contact element has been removed.

In the embodiment illustrated in FIGS. 1, 2*a*, 2*b*, the nitrogen is introduced via a neck tube 12, one end of which is connected to outer jacket 3 and the other end of which is connected to the helium tank 8, thus allowing access to the helium tank 8 (FIG. 1). In stationary operation, the neck tube 12 is used to accommodate a cold head of a refrigerator. In this way, one cold stage of the cold head makes thermally conductive contact with the stationary section 11*a*. The refrigerator is removed during transport. Instead, the supply tube 7 is introduced together with the moving part 11*b* of the contact element into neck tube 12, via which liquid nitrogen 6 can be conveyed from the external nitrogen vessel 4 to the movable section 11*b*. The stationary section 11*a* of the contact element in the illustrated embodiment is used both during stationary operation and during transport for making contact between the radiation shield 10 with the cooling medium in question (nitrogen 6 and cooling stage of the refrigerator).

FIGS. 2*a* and 2*b* illustrate a contact surface 13 constructed from a material with high heat conductance, e.g. copper plate, to improve the heat conductance between the movable section 11*b* and the stationary section 11*a*, and which is part of the movable section 11*b* (not shown in FIG. 1 due to the resolution). Thermal contact of the movable section 11*b* with the stationary section 11*a* is implemented either by means of a mechanical contact between the two sections 11*a*, 11*b*, by the application of force (e.g. a screwed connection) or by a gas gap between the movable section 11*b* and a stationary section 11*a*. The surfaces facing each other of the movable section 11*b* and the stationary section 11*a* of the contact element make almost form-fit contact and form the gas gap, which is filled with helium gas 15 (FIG. 2*a*.). Transfer via the gas gap is preferable because no mechanical forces are then applied to the neck tube and assembly/removal is greatly simplified. In FIG. 2*b*, the nitrogen vessel 4 and the supply tube 7 are illustrated removed from the configuration. An end plate 18 of the neck tube 12 is also shown.

Figure 3:
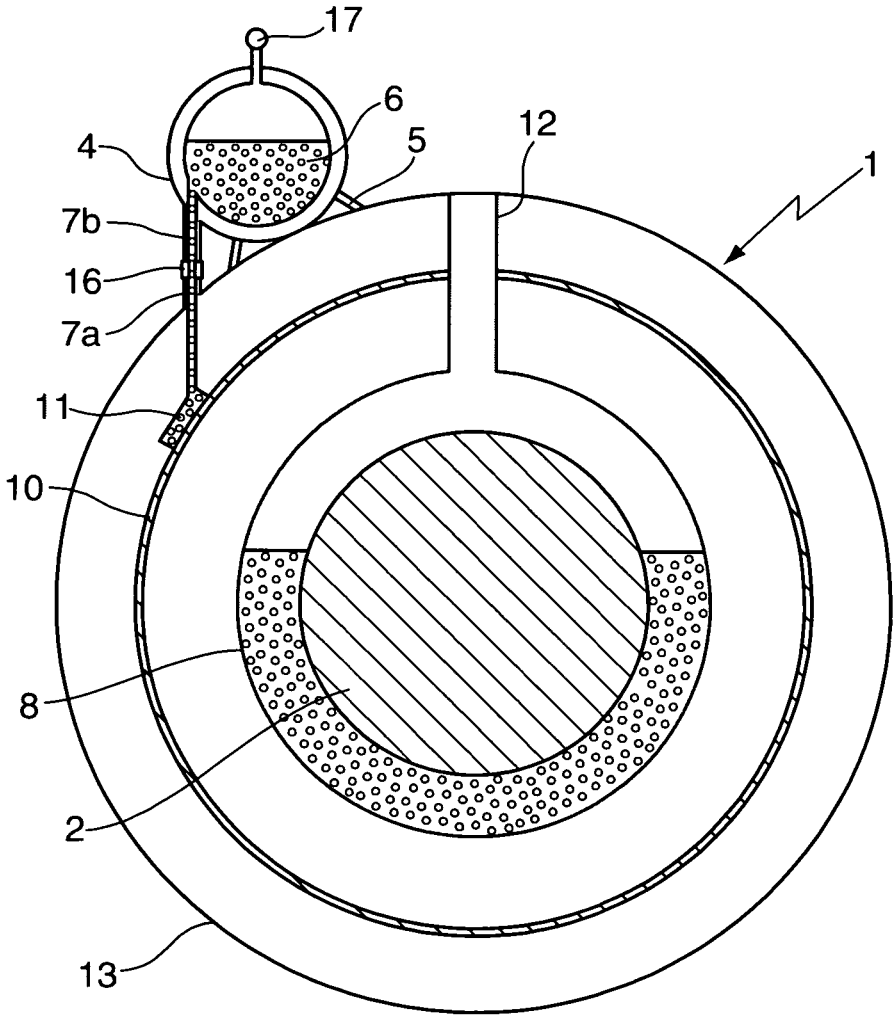
FIG. 3 a cross-section of an inventive cryostat configuration with a thermal contact outside the neck tube via a stationary supply section.

FIG. 3 shows another embodiment of the inventive cryostat configuration 1'. The liquid nitrogen 6 is not conveyed via a neck tube but via a separate access 16 through the outer jacket 3 to radiation shield 10. Here, too, the radiation shield 10 is in thermal contact with the liquid nitrogen 6 from the external nitrogen vessel 4 via a contact element 11'. The contact element 11' of the embodiment illustrated in FIG. 3 of the inventive cryostat configuration 1' does not, however, comprise a movable section. A stationary supply tube section 7*a* permanently installed in the cryostat configuration 1' extends from the contact element 11' to the outer jacket 3. This stationary supply tube section 7*a* can be connected to a movable supply tube section 7*b*, which itself leads into the external nitrogen vessel 4. In this case, the nitrogen is partially conveyed via the supply tube 7*a* which is permanently installed in the cryostat configuration 1' and to which the movable supply tube section 7*b* can be flanged. The contact element 11 can make contact with the radiation shield 10 either at points or over a large area. Thus, for example, part of the stationary supply tube section 7*a* can be wound directly around the radiation shield 10, thus itself serving as a contact element 11'. If nitrogen is conveyed via such a separate access 16, the nitrogen vessel 4 can be disposed below the neck tube 12. The introduction of nitrogen via a stationary supply tube section is in principle also conceivable together with a supply tube via neck tube 12 of a cryostat configuration 1.

As FIG. 2*b* shows, the nitrogen vessel 4, the supply tube 7, and the movable section 11*b* of the contact element 11 can be removed out of or away from the cryostat configuration 1 after transport. The same applies to the nitrogen vessel 4 and the movable supply tube section 7*b* in the cryostat configuration 1' shown in FIG. 3. This results in a high degree of flexibility because the cryostat configuration 1, 1' features a compact design in stationary operation, which is achieved by dispensing with the nitrogen tanks integrated in the cryostat configuration 1, 1', and on the other hand the radiation shield 10 of the inventive cryostat configuration 1, 1' can be cooled during transport by simple and effective means with liquid nitrogen 6, so that a long transport time can be achieved without great expense and deployment of personnel and materials.

LIST OF REFERENCES

1, 1' Cryostat configuration
2 Magnet coil

3 Outer jacket
4 External nitrogen vessel
5 Fixing clip
6 Liquid nitrogen
7 Supply tube
7*a* Stationary section of supply tube
7*b* Movable section of supply tube
8 Helium tank
9 Liquid helium
10 Radiation shield
11' Contact element
11*a* Stationary section of the thermal contact element
11*b* Movable section of the thermal contact element
11*c* Coupling element
12 Neck tube
13 Contact surface
15 Helium gas
16 Separate access
17 Discharge valve
18 End plate

I claim:

1. A method for cooling a cryostat configuration during transport thereof, the cryostat configuration having a superconducting magnet coil in a helium tank containing liquid helium and surrounded by at least one radiation shield, wherein cooling inside the cryostat configuration in stationary operation is performed entirely without liquid nitrogen by means of a refrigerator, the method comprising the steps of:

a) switching-off the refrigerator prior to transporting the cryostat configuration;

b) removing the refrigerator from the cryostat configuration;

c) conveying, at a beginning of transport and following step b), liquid nitrogen from an external nitrogen vessel to the cryostat configuration via a supply tube;

d) establishing thermal contact between the liquid nitrogen and the radiation shield in the cryostat configuration using a thermal contact element;

e) deactivating the supply of liquid nitrogen at an end of transport; and f) reinstalling the refrigerator following step e).

2. A device for cooling a cryostat configuration during transport thereof using liquid nitrogen from an external nitrogen vessel, the cryostat configuration having a refrigerator and at least one radiation shield, the device comprising:

means for switching-off the refrigerator prior to transporting the cryostat configuration;

means for removing the refrigerator from the cryostat configuration;

means for conveying, at a beginning of transport and subsequent to removal of the refrigerator, liquid nitrogen from the external nitrogen vessel to the cryostat configuration via a supply tube, the supply tube being structured for removal from the cryostat: configuration before stationary operation starts;

a thermal contact element structured for establishing thermal contact between the liquid nitrogen and the radiation shield, wherein the supply tube conveys liquid nitrogen from the nitrogen vessel to the contact element during transport, the supply tube being connected to a movable section of the contact element and can be removed together therewith from the cryostat configuration before stationary operation starts;

means for deactivating the supply of liquid nitrogen at an end of transport; and means for reinstalling the refrigerator following the end of transport the cryostat configuration comprising:

an outer jacket;

a helium tank containing liquid helium, the helium tank disposed within the outer jacket;

a superconducting magnet coil disposed within the helium tank;

the at least one radiation shield, the radiation shield surrounding the helium tank, wherein the thermal contact element has at least one stationary section in permanent thermal contact with the radiation shield; and the refrigerator, wherein the cryostat configuration is cooled in stationary operation by means of the refrigerator and entirely without liquid nitrogen.

3. The cryostat configuration of claim 2, wherein the nitrogen vessel can be removed from the cryostat configuration before stationary operation starts.

4. The cryostat configuration of claim 2, wherein a neck tube accommodates a cold head of the refrigerator, one end of the neck tube being connected to the outer jacket and an other end being connected to the helium tank, wherein the contact element is disposed in the neck tube and the stationary section of the contact element makes thermally conductive contact with one cold stage of the cold head during stationary operation and with the liquid nitrogen conveyed via the supply tube during transport operation.

5. The cryostat configuration of claim 2, wherein the stationary section of the contact element comprises at least two contact surfaces, between which there is a gas gap via which heat from the radiation shield is dissipated.

6. The cryostat configuration of claim 2, wherein at least one fixing element for fixing at least one nitrogen vessel is provided on an exterior of the outer shield.

7. The cryostat configuration of claim 2, wherein the cold head of the refrigerator has two cold stages that can be operated at different cryogenic temperatures.

8. The cryostat configuration of claim 2, wherein the superconducting magnet coil is part of an MR, NMR, MRI, or FTMS configuration.

9. A transport vessel for transporting the cryostat configuration of claim 2, with the installed nitrogen vessel having liquid nitrogen and the supply tube that leads from the nitrogen vessel to a connection device for connection to the cryostat configuration.

10. The cryostat configuration of claim 3, wherein a neck tube accommodates a cold head of the refrigerator, one end of the neck tube being connected to the outer jacket and an other end being connected to the helium tank, wherein the contact element is disposed in the neck tube and the stationary section of the contact element makes thermally conductive contact with one cold stage of the cold head during stationary operation and with the liquid nitrogen conveyed via the supply tube during transport operation.

11. The cryostat configuration of claim 3, wherein the stationary section of the contact element comprises at least two contact surfaces, between which there is a gas gap via which heat from the radiation shield is dissipated.

12. The cryostat configuration of claim 4, wherein the stationary section of the contact element comprises at least two contact surfaces, between which there is a gas gap via which heat from the radiation shield is dissipated.

13. The cryostat configuration of claim 10, wherein the stationary section of the contact element comprises at least two contact surfaces, between which there is a gas gap via which heat from the radiation shield is dissipated.

14. The cryostat configuration of claim 3, wherein at least one fixing element for fixing at least one nitrogen vessel is provided on an exterior of the outer shield.

15. The cryostat configuration of claim 4, wherein at least one fixing element for fixing at least one nitrogen vessel is provided on an exterior of the outer shield.

16. The cryostat configuration of claim 10, wherein at least one fixing element for fixing at least one nitrogen vessel is provided on an exterior of the outer shield.

17. The cryostat configuration of claim 5, wherein at least one fixing element for fixing at least one nitrogen vessel is provided on an exterior of the outer shield.

18. The cryostat configuration of claim 11, wherein at least one fixing element for fixing at least one nitrogen vessel is provided on an exterior of the outer shield.

19. The cryostat configuration of claim 12, wherein at least one fixing element for fixing at least one nitrogen vessel is provided on an exterior of the outer shield.

20. The cryostat configuration of claim 13, wherein at least one fixing element for fixing at least one nitrogen vessel is provided on an exterior of the outer shield.

* * * * *